United States Patent [19]

Horst et al.

[11] 4,179,869

[45] Dec. 25, 1979

[54] STIRRUP BUCKLE SHEATH

[75] Inventors: Thomas A. Horst, 2801 N. 111th St., Lafayette, Colo. 80026; Charles L. Welton, Golden, Colo.

[73] Assignee: Thomas A. Horst, Lafayette, Colo. ; a part interest

[21] Appl. No.: 907,975

[22] Filed: May 22, 1978

[51] Int. Cl.[2] ..... B68C 1/16

[52] U.S. Cl. ..... 54/46; 54/65; 24/164

[58] Field of Search ..... 54/46, 47, 65, 1; 24/163 FC, 163 R, 164, 181; 2/322, 323

[56] References Cited

U.S. PATENT DOCUMENTS

| | | | |
|---|---|---|---|
| 545,447 | 9/1895 | Bringham | 54/65 |
| 3,314,121 | 4/1967 | Blevins et al. | 24/181 |
| 4,141,198 | 2/1979 | Gaertner | 54/46 |

*Primary Examiner*—Hugh R. Chamblee
*Attorney, Agent, or Firm*—Edwin L. Spangler, Jr.

[57] ABSTRACT

This invention relates to a formed leather sheath for covering the buckles of adjustable stirrup-supporting belts on a saddle, said sheath being characterized by a buckle-receiving pocket open on both ends, a necked-down section integrally formed on one open end sized to slide freely along the belt without passing over the buckle, strap-forming means depending from the other open end sized to encircle the belt, and fastener means cooperating with said strap means to define an openable collar effective in closed position with the necked-down position abutting one end of the buckle to engage the belt on the other end of said buckle and maintain the latter within the pocket.

6 Claims, 7 Drawing Figures

STIRRUP BUCKLE SHEATH

Most, if not all, saddles include as a part thereof a pair of leather straps hanging down on opposite sides thereof that are looped through the eye of the stirrups. These straps are commonly referred to as "stirrup leathers"; however, for purposes of the present description, they will henceforth be denominated as "stirrup-supporting belts" both because structurally they are closely analogous to a belt and, secondly, to more clearly differentiate between other uses of the word "leather" that will be made from time to time.

These stirrup-supporting belts have in common some type of buckle which upon actuation permits the rider to adjust the height of the stirrups to suit his or her individual needs. A half dozen or more types of stirrup buckles are in common use, the majority of these buckles including a pair of transversely-spaced pins carried by one layer of the belt that fit into any one of several pairs of apertures in another when these layers are laid in face-to-face overlapping relation. The main differences between these buckles lie in the metal parts that clamp onto or slide onto the overlapped layers at the site of the pins in a manner to keep them in their holes or apertures.

Now, the problem is that these metal buckle parts abraid and scratch the leather and sometimes even the rider's calf as they move back and forth thereacross during the normal leg movement associated with riding a horse. Oftentimes, these leather surfaces are handsomely tooled and/or studded with decorative silver medallions and the like which make it even more imperative that some protection be provided against stirrup buckle damage. Moreover, it is not the flat faces of the buckle that contact the rider's leg and the parts of the saddle between it and the horse, but instead, the edges and corners thereof due to the fact that the stirrups are rotated about a quarter of a turn in order for the toes to enter them thus turning the buckles out of parallel and into skewed relation. Finally, while admittedly rare, these stirrup buckles can and do, on occasion, come open usually because they have caught upon something alongside the trail or wherever the horse is being ridden.

It has now been found in accordance with the teaching of the instant invention that the wear and damage caused by these stirrup buckles abraiding against the leather surfaces between them and the horse's body can, in large measure, be eliminated by the simple, yet unobvious, expedient of encasing them in a leather sheath which can be opened and slid out of the way to provide access to the buckle whenever it needs to be actuated while, at the same time, remaining a more or less permanent part of the stirrup-support assembly at least insofar as accidental removal is concerned. The sheath being formed of leather of generally the same type and quality as that out of which the saddle itself is made, blends nicely therewith and definitely enhances its decorative appearance. In addition to protecting the saddle from wear and abrasion, the saddle buckle sheath also constitutes a relatively soft protective cover therefor that prevents the calf of the rider's leg from being chafed and injured. Finally, with the buckle housed inside the sheath, it is virtually impossible for it to open accidentally, especially since the fastener is located on the inside of the loop defined by the stirrup-supporting belt.

It is, therefore, the principal object of the present invention to provide a novel stirrup buckle sheath.

A second objective is the provision of a device of the character described which is shaped from saddle leather.

Another object of the within described invention is to provide a stirrup buckle cover that remains semi-permanently attached to the stirrup-support belt yet can be opened and slid up out of the way to provide access to the latter.

Still another objective is the provision of a device of the character described which serves the incidental, but nonetheless important, function of keeping the buckle closed.

Another additional object is to provide a leather buckle sheath that is essentially universal in its ability to encase and form a protective shield around nearly all the commonly used stirrup buckles.

Further objects are to provide stirrup buckle covers which are simple, easy to use, versatile, compact, safe, decorative and which require no special tools or skill to mount and demount.

Other objects will be in part apparent and in part pointed out specifically hereinafter in connection with the description of the drawings that follows, and in which.

Figure 1:
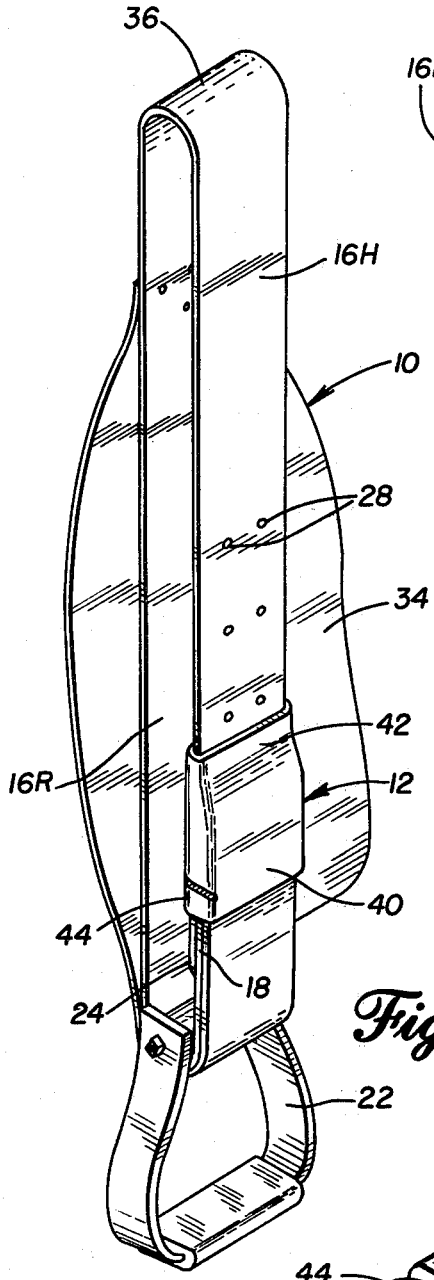
FIG. 1 is a perspective view showing the sheath of the present invention in place over the buckle of a conventional saddle stirrup subassembly.
Figure 3:
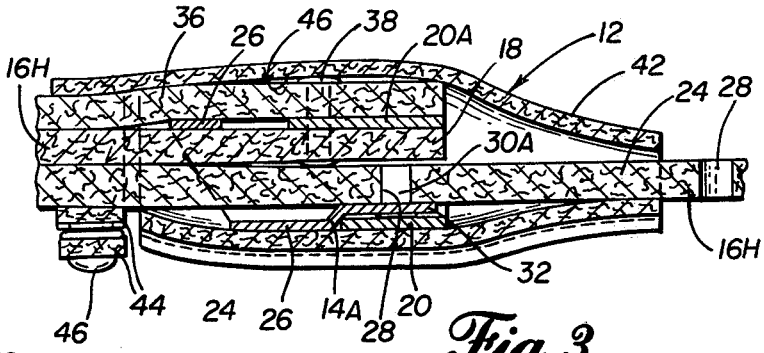
FIG. 3 is a fragmentary section taken along line 3—3 of FIG. 2 but to a still further enlarged scale.
Figure 4:
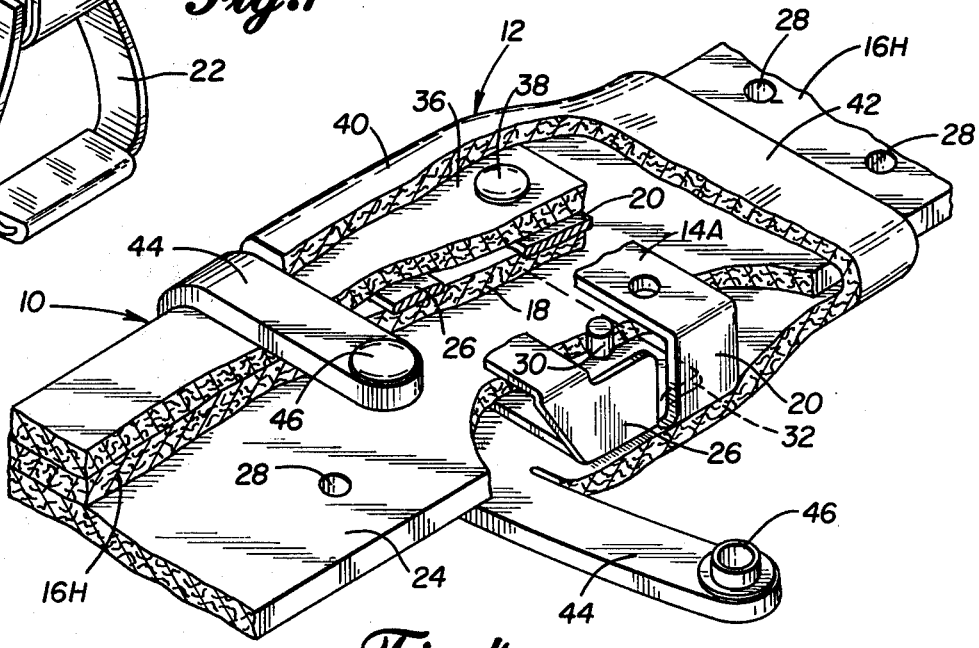
FIG. 4 is a fragmentary perspective view to approximately the same scale as FIG. 3 but with portions broken away and shown in section so as to better reveal the interior construction.

Referring next to the drawings for a detailed description of the present invention and, initially, to FIGS. 1, 3 and 4 for this purpose, reference numeral 10 has been chosen to broadly designate one of the two stirrup subassemblies hanging from a conventional saddle and forming a part thereof, while numeral 12 similarly designates the buckle sheath for use therewith to enclose the stirrup buckle 14, three different types of the latter having been shown and designated respectively as 14A, 14B and 14C. The stirrup-supporting belt 16 has one end 18 (FIGS. 3 and 4) riveted or otherwise permanently attached to the looped slide 20 of two-part metal stirrup buckle 14A. This end 18 of the stirrup-supporting belt lies inside the loop formed by the latter and, therefore, is next to the horse's body. For purposes of identification herein, the portion of the loop next to the horse will be designated 16H while that lying next to the rider's leg will be referred to as 16R.

From its point of attachment to the looped slide 20 of the buckle, section 16H of the belt is reaved up and through slots in the saddletree (not shown) that supports the stirrup subassembly 10, then down along the inside of the rider's leg (section 16R), through the foot-receiving opening 22 in the stirrup and back up along the horse's body (section 16H again) and through the loop in buckle element 20 to where end 24 thereof is detachably connected to the pin-carrying part 26 of two-part buckle 14A. End 24 of the stirrup-supporting belt loop carries the pairs of apertures 28 into which the pins 30 of tongue 32 projecting from the pin-carrying part seat. Once these pins 30 have been placed in the proper pair of apertures 28, the looped slide 20 can be slid over the tongue 32 thus maintaining the buckle in assembled relation while, at the same time, fixing the size of the stirrup-carrying loop.

Every part of the stirrup support subassembly described up to this point is old in the art as is another part thereof shown in FIGS. 1, 3 and 4, namely, decorative fender 34. Fenders such as this are sometimes used both for purposes of decoration and also to protect the rider's leg from brush, low limbs and other hazards. Its only significance to the present invention is the fact that it provides another thickness of leather strap 36 that must be accommodated inside sheath 12. This strap extends from fender 34 of which it forms an integral part and is folded underneath the outside of belt 16 as the latter passes through the stirrup then up to a point of attachment with the stirrup buckle slide, rivets 38 being used to permanently fasten strap 36, belt 16 and slide 20A together as shown.

Next, with reference to FIGS. 1–4, inclusive, of the drawings, the sheath 12 forming the subject matter of the instant invention will be described in detail. It comprises a buckle-receiving pocket 40 sized to encase the entire two-part stirrup buckle in closed position along with the opposite ends 18 and 28 of looped belt 16 connected thereto as a minimum. If, as illustrated, the particular stirrup subassembly 10 also includes yet another strap 36 connected to the buckle, the size of the pocket 40 is correspondingly enlarged to accept it also. This buckle-receiving pocket is open on both ends but the end designed to pass only the single thickness of stirrup belt is necked-down as indicated at 42 to receive the latter for free sliding movement yet not pass over the two or more thicknesses of strap along with the buckle that is housed in the center section. In order to gain access to the buckle for actuating same, therefore, the sheath need only be slid up the single thickness of belting until the buckle and multiple thicknesses of belting at this point are exposed. In so doing, the sheath remains attached to the assembly at all times.

Figure 2:
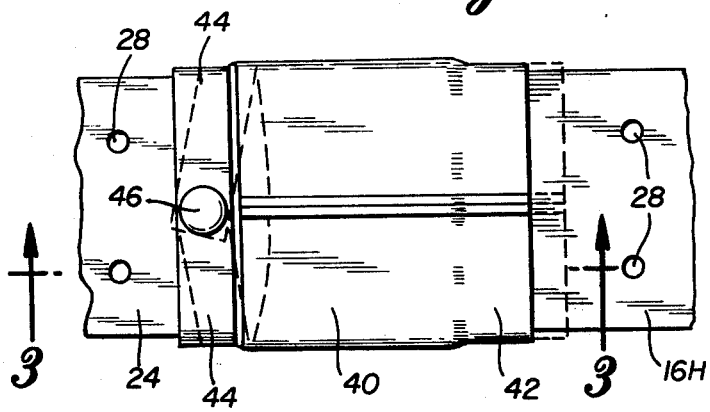
FIG. 2 is a fragmentary outside elevation to a greatly enlarged scale showing the sheath in place around a stirrup buckle and how the strap foreshortens and reduces the size of the belt-encircling collar as the remainder thereof is moved longitudinally away therefrom.

Now, on the open end of the buckle pocket opposite the necked-down section 42 thereof, the sheath is provided with an integrally-formed strap 44 and fastener 46 that cooperate with one another to define an openable collar 44–46 sized to receive the two or more thicknesses of leather belting but too small to pass the buckle. In the particular form shown, this strap 44 comprises a pair of flaps cut free of the pocket, overlapped and detachably connected together where they overlap as shown most clearly in FIGS. 2, 3 and 4. Once the stirrup buckle is closed and housed inside pocket 40, the sheath thus formed cannot slide either up or down with the collar closed about the multilayered thickness of belt because the size of the collar is such as to not pass the buckle. In fact, as shown in FIG. 2, even with the collar approximately the same size as the corresponding open end of the pocket 40, any tendency of the sheath to move to the right into the phantom line position will result in the collar deforming and becoming smaller due to the frictional contact between its rough inner surface and that of the belt. Obviously, the better practice is to make the collar 44–46 smaller in the first instance; however, should it stretch and increase the size of the loop formed thereby, it will still function to keep the buckle seated in the pocket because of the action previously noted.

By forming two strap-forming flaps and placing the fastener on the overlapped ends as shown, it lies in the most convenient position to be actuated, namely, on the outside of the inside run 16H of the stirrup belt. Moreover, by placing the fastener in the middle as opposed to a single longer flap going all the way around, the collar is better protected against opening accidentally.

Figure 5:
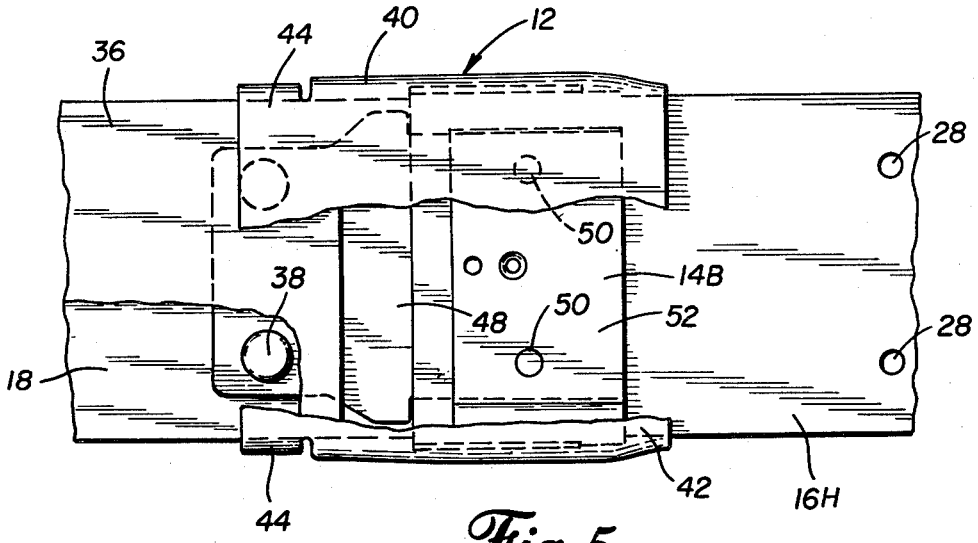
FIG. 5 is a fragmentary inside elevation to a scale approximating that of FIGS. 3 and 4 showing the sheath in use on a different type of stirrup buckle, portions of the sheath and belting having been broken away and shown in section to more clearly reveal the structures therebeneath.
Figure 6:
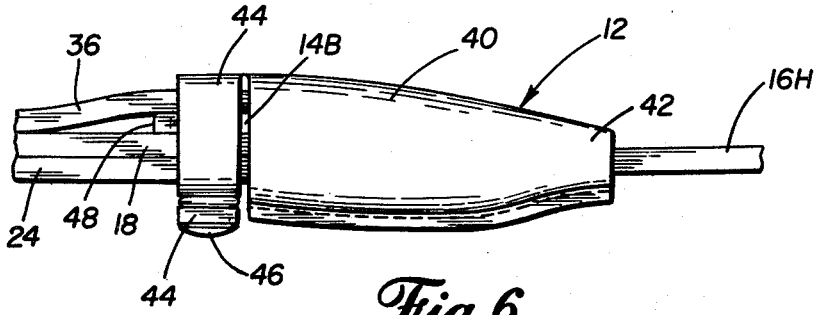
FIG. 6 is a side view of the assembly shown in FIG. 5.

FIGS. 5 and 6 show the sheath 12 in use on a second type of conventional stirrup buckle 14B. The belt 16 and other leather parts of the stirrup subassembly remain the same and, therefore, carry the same reference characters.

In buckle 14B, a pin-carrying male element 48 is sandwiched between strap 36 and end 18 of belt 16 and rivets 38 hold them in assembled relation. Once the pins 50 of the male element are seated in the apertures 28 in belt end 24, the female element or slide 52 is slid into place over the male element as shown in FIG. 5.

The necked-down section 42 of the sheath 12, as was the case with buckle 14A of FIGS. 1–4, slidably receives the apertured end 24 of the belt 16 while the pocket 40 therein is sized to encase the entire buckle in assembled relation along with at least two thicknesses of strap, i.e. overlapped ends 18 and 28 of belt 16 as a minimum and, in addition, strap 36 connected to fender 34 if such is used. The openable collar defined by the two-part fastener 46 and the overlapped integral flaps 44 in this instance is sized so that it cannot pass over female buckle element 52 even though it does encircle that relatively narrower tongue 54 of the male element that carries the rivets 38. In other words, so long as the collar 44–46 encircles and snugly engages some part of the stirrup subassembly on the opposite end of pocket 40 from necked-down portion 42 that is smaller than the largest portion housed inside the pocket, it will be effective to do its job, namely, maintain the sheath in buckle-covering position.

Figure 7:
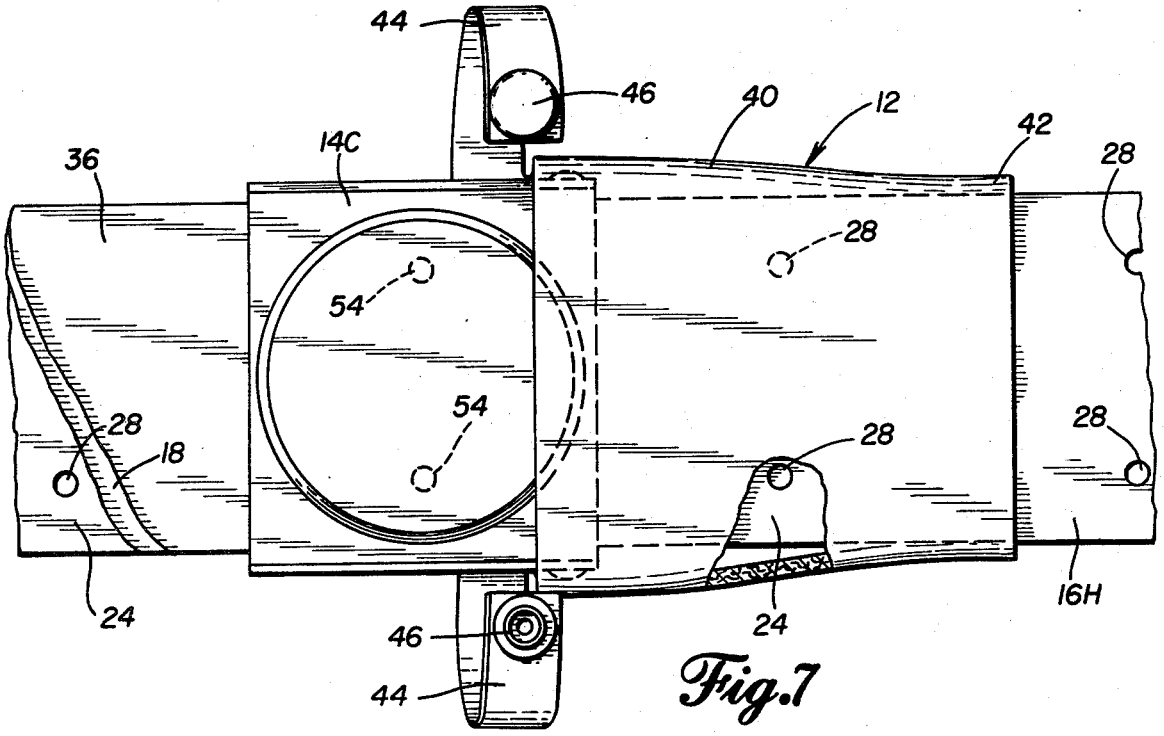
FIG. 7 is a fragmentary front elevation similar to FIG. 2 but to the scale of FIG. 5 showing the sheath in open position preparatory to sliding it into place over yet another type of stirrup buckle, once again with portions broken away and shown in section to better reveal the interior construction.

FIG. 7 to which brief reference will now be made shows yet another conventional type of stirrup buckle 14C, it being of the hinged clamshell type. In this instance, as with those previously described, the necked-down section 42 encircles apertured end 24 of belt 16, but such section is too small to pass over the buckle 14C. Pins 54 on the inside of one of the halves of the clamshell pass through pairs of aligned apertures in all three thicknesses of belting, i.e. fender end 36, and the overlapped ends 18 and 28 of belt 16. Collar 44–46 is sized and functions the same way with buckle 14C as it did with the others, specifically, to encircle the subassembly 10 on the opposite end thereof from that contained in necked-down portion 42 at a relatively smaller place thereon than that housed inside pocket 40.

Finally, with particular reference to FIGS. 2, 3 and 6, the sheath 12 will be seen to have been fabricated from a single sheet of belting leather which is generally rectangular except for the opposite sides at one end which are cut in slightly to form necked-down portion 42 when the side margins are brought together and sewn. In general, the flaps 44 when cut free and their free ends overlapped will reduce the size of the collar 44–46 approximately the proper amount less than the pocket 40 to snugly engage the assembly 10 as previously noted without being able to pass over the buckle 14. If, however, the foregoing provides insufficient overlap to accommodate the fastener and still fit around the two or three thicknesses of belting, ears can obviously be provided on the side margins of the sheet opposite the end thereof that is cut in to define the neck.

What is claimed is:

1. The sheath for removably encasing a two-part openable buckle on the overlapped ends of an adjustable stirrup-supporting belt which comprises: a sheet of leather shaped and closed to form a flattened tube open at both ends, said tube including a pocket intermediate its ends sized to accept the buckle in closed position and maintain same in such condition while housed therein, one of said ends being necked-down to a reduced size adapted to slidably receive the belt while remaining too small to pass over the buckle, at least one integrally-formed strap-forming flap depending from said other end of the tube, and fastener means carried by said flap cooperating therewith to define a belt-encircling collar, said collar being openable to pass over the buckle upon slidable movement of the pocket along the belt into buckle-receiving position, and said collar in closed position being effective to encircle said belt and prevent movement of the pocket therealong to a position where the buckle lies outside thereof.

2. The stirrup belt buckle sheath as set forth in claim 1 wherein said other end includes a pair of opposed strap-forming flaps arranged to encircle the belt in opposite directions.

3. The stirrup belt buckle sheath as set forth in claim 1 wherein said collar in closed position is sized to closely engage the belt and define a loop too small to pass over the buckle.

4. The stirrup belt buckle sheath as set forth in claim 1 wherein the sheet has contoured side margins shaped to cooperate with one another upon being brought together and sewn so as to define the pocket with the necked-down portion on one end and the belt-encircling collar on the other.

5. The stirrup belt buckle sheath as set forth in claim 2 wherein the opposed strap-forming flaps have free ends adapted to overlap one another when said flaps are arranged in belt-encircling relation.

6. The stirrup belt buckle sheath as set forth in claim 5 wherein the fastener means comprises a two-part snap fastener detachably interconnecting the overlapped flap ends.

* * * * *